US006659887B2

(12) United States Patent
Watanabe

(10) Patent No.: US 6,659,887 B2
(45) Date of Patent: Dec. 9, 2003

(54) SOLID GOLF BALL

(75) Inventor: Hideo Watanabe, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 141 days.

(21) Appl. No.: 09/858,978

(22) Filed: May 17, 2001

(65) Prior Publication Data

US 2002/0019270 A1 Feb. 14, 2002

(30) Foreign Application Priority Data

Jun. 28, 2000 (JP) ..... 2000-194701

(51) Int. Cl.[7] ..... A63B 37/04; A63B 37/06; A63B 37/00

(52) U.S. Cl. ..... 473/371; 473/351

(58) Field of Search ..... 473/351–378

(56) References Cited

U.S. PATENT DOCUMENTS 5,002,281 A * 3/1991 Nakahara et al. ..... 473/373
5,072,944 A * 12/1991 Nakahara et al. ..... 473/373
5,403,010 A * 4/1995 Yabuki et al. ..... 473/372
5,607,366 A * 3/1997 Yokota et al. ..... 273/DIG. 22
5,711,723 A * 1/1998 Hiraoka et al. ..... 473/374
5,776,012 A * 7/1998 Moriyama et al. ..... 473/372
5,803,833 A * 9/1998 Nakamura et al. ... 273/DIG. 20
5,830,085 A * 11/1998 Higuchi et al. ..... 473/373
5,848,942 A * 12/1998 Kato ..... 473/365
6,045,459 A * 4/2000 Sugimoto et al. ..... 473/354
6,302,810 B2 * 10/2001 Yokota ..... 473/377
6,319,154 B1 * 11/2001 Yoshida et al. ..... 473/377
6,319,155 B1 * 11/2001 Moriyama et al. ..... 473/371
6,336,872 B1 * 1/2002 Moriyama et al. ..... 473/374
6,354,967 B1 * 3/2002 Nakamura et al. ..... 473/377
6,386,993 B1 * 5/2002 Yokota ..... 473/373
6,494,794 B1 * 12/2002 Ohama ..... 473/371

FOREIGN PATENT DOCUMENTS

JP 5-123422 5/1993
JP 6-154357 6/1994
JP 8-276033 10/1996
JP 9-28830 2/1997
JP 9-28831 2/1997
JP 11-285472 A * 4/2001 ..... A63B/37/00

* cited by examiner

*Primary Examiner*—Paul T. Sewell
*Assistant Examiner*—Alvin A. Hunter, Jr.
(74) *Attorney, Agent, or Firm*—Sughrue Mion, PLLC

(57) ABSTRACT

A solid golf ball includes a core and a cover. The golf ball satisfies the following conditions (1) to (3):

(1) the cover has a thickness of at least 2.5 mm;

(2) the cover has a Shore D hardness of 59 to 62; and (3) a value obtained through subtraction of JIS C hardness of a center portion of the core from JIS C hardness of a surface portion of the core is at least 8.

7 Claims, No Drawings

SOLID GOLF BALL

BACKGROUND OF THE INVENTION

1. Field of the Invention

The present invention relates to a solid golf ball including a core and cover, and, more particularly, to a solid golf ball which has improved flight performance and durability against cracking and which provides a golfer with good feeling on impact.

2. Description of the Related Art

Since solid golf balls are more excellent than thread-wound golf balls in terms of flight performance and durability against cracking, solid golf balls are widely used among amateur golfers. However, solid golf balls having higher durability against cracking have been demanded.

One conceivable measure for coping with such demand is increasing the hardness or thickness of the cover of a solid golf ball to thereby improve durability against cracking. However, conventional techniques for increasing the hardness or thickness of the cover of a solid golf ball have involved various problems.

For example, Japanese Patent Publication No. JP-A-93-123422 discloses a golf ball having a hard cover of a thickness of 2.2 to 2.9 mm; Japanese Patent Publication No. JP-A-94-154357 discloses a golf ball having a hard cover of a thickness of 2.1 to 2.8 mm; and Japanese Patent Publication No. JP-A-97-28830 discloses a golf ball having a hard cover of a thickness of 3 to 5 mm. However, in these golf balls, since the cover is excessively hard, durability against cracking and feeling on impact are not satisfactory.

Further, Japanese Patent Publication No. JP-A-97-28831 discloses a golf ball having a cover of a thickness of 3 to 5 mm and a Shore D hardness of 50 to 60. However, this golf ball does not have sufficient flight performance, because the cover is made excessively soft in order to improve controllability and feeling.

Moreover, Japanese Patent Publication No. JP-A-96-276033 discloses a golf ball designed such that the difference in p-hardness between the core and the entirety of the golf ball falls within a predetermined range in order to improve flight performance and feeling. However, this golf ball does not have sufficient flight performance, because of a flat hardness distribution of the core.

SUMMARY OF THE INVENTION

In view of the foregoing, an object of the present invention is to provide a solid golf ball which, through increasing the thickness of the cover, has improved flight performance and durability against cracking, while providing a golfer with good feeling on impact.

To achieve the above object, the present invention provides a solid golf ball comprising a core and a cover, the golf ball satisfying the following conditions (1) to (3):

(1) the cover has a thickness of at least 2.5 mm;

(2) the cover has a Shore D hardness of 59 to 62; and (3) a value obtained through subtraction of JIS C hardness of a center portion of the core from JIS C hardness of a surface portion of the core is at least 8.

In the golf ball of the present invention, the thickness and hardness of the cover are determined in consideration of attaining balance therebetween, and the difference between the JIS C hardness of the core center portion and that of the core surface portion is set optimally. Thus, the solid golf ball of the present invention has increased durability against cracking and enhanced flight performance and provides a golfer with improved feeling on impact.

DESCRIPTION OF THE INVENTION AND PREFERRED EMBODIMENTS

The present invention will next be described in detail. The solid golf ball of the present invention includes a core and a cover. The core material is not particularly limited. For example, vulcanized rubber containing a predominant amount of polybutadiene rubber, polyisoprene rubber, natural rubber, or silicone rubber can be used. However, vulcanized rubber containing a predominant amount of polybutadiene rubber is particularly preferred.

In the present invention, pentachlorothiophenol or a metallic salt of pentachlorothiophenol may be added to the core material, which enables formation of a core having high resilience, to thereby improve the flight performance of the ball. Pentachlorothiophenol or a metallic salt of pentachlorothiophenol is preferably a zinc salt of pentachlorothiophenol; for example, Renacit IV (product of Bayer Corp.). Pentachlorothiophenol or a metallic salt thereof is added to the core material in an amount of 0.1 to 2.0 parts by weight, preferably 0.2 to 1.0 parts by weight, on the basis of 100 parts by weight of the base rubber. When the incorporation amount of pentachlorothiophenol or a metallic salt thereof is excessively small, the resilience of the core cannot be increased sufficiently, so that the resilience of the golf ball may decrease with a resultant decrease in travel distance. When the incorporation amount of pentachlorothiophenol or a metallic salt thereof is excessively large, the pentachlorothiophenol or a metallic salt thereof hinders cross linking reaction of a rubber composition that forms the core.

In the present invention, the value obtained through subtraction of JIS C hardness of a center portion of the core from JIS C hardness of a surface portion of the core is at least 8, preferably 8 to 20, more preferably 10 to 18. When the hardness difference is excessively small, spin of the golf ball upon hit by a driver increases excessively, possibly resulting in a decrease in travel distance. When the hardness difference is excessively large, durability against cracking may be impaired.

The JIS C hardness of the core surface portion is typically 70 to 85, preferably 74 to 81. When the JIS C hardness of the core surface portion is excessively low, spin of the golf ball increases, possibly resulting in a decrease in travel distance. When the JIS C hardness of the core surface portion is excessively high, feeling on impact may become too hard, and durability against cracking may be impaired.

The JIS C hardness of the core center portion is typically 55 to 69, preferably 57 to 67, more preferably 59 to 65. When the JIS C hardness of the core center portion is excessively low, durability against cracking may be impaired. When the JIS C hardness of the core center portion is excessively high, feeling on impact may become too hard, and spin of the golf ball increases, possibly resulting in a decrease in travel distance.

The $\mu$-hardness of the core; i.e., deflection (deformation) amount when applied load is increased from an initial load of 98N (10 kgf) to 1275 N (130 kgf), is typically 2.7 to 5.5 mm, preferably 3.0 to 5.0 mm, more preferably 3.3 to 4.5 mm. When the $\mu$-hardness of the core is excessively high, feeling on impact may become too hard, and spin of the golf ball increases, possibly resulting in a decrease in travel distance. When the $\mu$-hardness of the core is excessively low, feeling on impact may become too soft, and durability against cracking may be impaired.

The core may assume a single-layer structure formed of a single material or a multilayer structure composed of two or more layers of different materials. When the core has a multilayer structure, "JIS C hardness of a surface portion of a core" appearing previously means the hardness of a surface portion of the outermost layer of the core. When the core has a multilayer structure, preferably, all the layers of the core are mainly formed of a rubber material.

A cover material of the golf ball of the present invention is not particularly limited. For example, the cover may be made of an ionomer resin or a mixture of a predominant amount of an ionomer resin and a polyester resin, a polyurethane resin, a polyamide resin, or a polyolefin resin. Particularly, ionomer resins such as those commercially available from Du Pont, Ltd. under the trade name Surlyn and from Du Pont Mitsui Polychemicals Co., Ltd. under the trade name Himilan are preferred.

The material suitable for the cover of the golf ball of the present invention contains a dominant amount of a blend resin containing an ionomer resin neutralized by divalent metal ions (e.g., $Zn^{++}$) (10 to 90% by mass) and an ionomer resin neutralized by monovalent metal ions (e.g., $Na^{+}$) (90 to 10% by mass). This enables formation of a cover having high durability and sufficient resilience. The ionomer resin neutralized by divalent metal ions and the ionomer resin neutralized by monovalent metal ions are preferably blended together at a ratio (20 to 80% by mass): (80 to 20% by mass), more preferably, (25 to 75% by mass): (75 to 25% by mass).

The cover has a thickness of at least 2.5 mm, preferably, at least 2.7 mm, more preferably, at least 3.0 mm. When the cover is excessively thin, durability against cracking becomes insufficient. Further, the thickness of the cover is not greater than 5 mm, preferably not greater than 4 mm. When the cover is excessively thick, the resilience of the golf ball decreases, possibly resulting in a decrease in travel distance.

The cover has a Shore D hardness of 59 to 62, preferably, 59 to 61, more preferably, 60 to 61. When the cove is excessively soft, the resilience of the golf ball decreases, and spin of the golf ball increase, possibly resulting in a decrease in travel distance. When the cover is excessively hard, durability against cracking is impaired, as is feeling upon hit by a club, in particular, an iron club.

The thus-obtained golf ball may be finished through application of coating to the surface and stamping the surface with marking as needed. The $\mu$-hardness of the entire ball; i.e., deflection (deformation) amount when applied load is increased from an initial load of 98N (10 kgf) to 1275 N (130 kgf), is preferably 2.3 mm to 3.5 mm, more preferably 2.6 mm to 3.3 mm. The ball can be formed in such a manner as to have a diameter not less than 42.67 mm and a weight not greater than 45.93 g as specified under the Rules of Golf as approved by R&A.

EXAMPLES

The present invention will next be described with reference to examples, which are not to be construed as limiting the invention.

Examples and Comparative Examples

Solid cores for golf balls of Examples 1 to 4 and Comparative Examples 1 to 5 were formed by the steps of: kneading corresponding rubber compositions for core use shown in Tables 1 and 2; and vulcanizing the resultant rubber materials for approximately 15 minutes at a temperature of 155° C. in corresponding core molds. The solid core of Comparative Example 5 was formed by successively performing a first vulcanization (140° C., 30 minutes) and a second vulcanization (170° C., 10 minutes). In Tables 1 and 2, peroxide (1) is dicumyl peroxide commercially available from NOF Corp. under the trade name Percumyl D; peroxide (2) is 1,1-bis(t-butyl peroxy)3,3,5-trimethylcyclohexane commercially available from NOF Corp. under the trade name Perhexa 3M-40; antioxidant is that commercially available from Ouchi Shinko Chemical Industry Co., Ltd. under the trade name Nocrac NS-6; and zinc salt of pentachlorothiophenol is that commercially available from Bayer Corp. under the trade name Renacit IV.

The thus-obtained cores were covered with corresponding cover materials shown in Table 3 through injection molding, followed by normal coating to thereby manufacture golf balls of Examples 1 to 4 and Comparative Examples 1 to 5.

The golf balls were tested for flight performance, durability against cracking, and feeling on impact by the following methods. Test results are shown in Tables 1 and 2.

Flight Performance

A golf ball was struck at a club head speed of 45 m/s by use of a driver (W #1) mounted on a swing robot, to thereby measure a travel distance and a spin rate. The travel distance was evaluated as follows.

○: Total distance is 227.0 m or greater

X: Total distance is 226.0 m or less

Durability against Cracking

A golf ball was repeatedly struck at a club head speed of 40 m/s by use of a driver mounted on the swing robot, to thereby measure the number of strikes at which the ball began to crack. Durability against cracking was evaluated according to the following criteria. Notably, a ball was struck at a random point. For each of Examples 1 to 4 and Comparative Examples 1 to 5, ten balls were tested, and a ball which cracked earliest was selected to determine the number of strikes at which cracking started.

○: cracking started at 230 or more strikes.

X: cracking started at 220 or fewer strikes.

Feeling

Ten amateur golfers struck the golf balls using a driver (W#1) and a ninth iron (I#9) and evaluated their feelings on impact according to the following criteria.

○: Good

X: Too hard

TABLE 1

| | | Example 1 | Example 2 | Example 3 | Example 4 |
|---|---|---|---|---|---|
| Ball | Diameter (mm) | 42.7 | 42.7 | 42.7 | 42.7 |
| | Weight (g) | 45.3 | 45.3 | 45.3 | 45.3 |
| | $\mu$ Hardness (mm) | 2.7 | 3.0 | 3.3 | 2.8 |
| Core | Diameter (mm) | 36.6 | 36.6 | 36.7 | 36.7 |
| | $\mu$ Hardness (mm) | 3.5 | 3.9 | 4.3 | 3.5 |
| | Surface JIS-C hardness: X | 81 | 76 | 74 | 81 |
| | Center JIS-C hardness: Y | 64 | 62 | 60 | 64 |
| | Hardness difference: X-Y | 17 | 14 | 14 | 17 |
| Cover | Cover material | b | b | b | a |
| | Thickness (mm) | 3.0 | 3.0 | 3.0 | 3.0 |
| | Shore D Hardness | 60 | 60 | 60 | 59 |
| Composition of core | Polybutadiene | 100 | 100 | 100 | 100 |
| | Zinc acrylate | 29.6 | 27.3 | 25.3 | 29.6 |
| | Peroxide (1) | 0.6 | 0.6 | 0.6 | 0.6 |
| | Peroxide (2) | 0.6 | 0.6 | 0.6 | 0.6 |
| | Antioxidant | — | — | — | — |
| | Barium sulfate | — | — | — | — |
| | Zinc oxide | 25.4 | 26.3 | 27.1 | 25.4 |
| | Zinc salt of | 1 | 1 | 1 | 1 |

TABLE 1-continued

| | | Example 1 | Example 2 | Example 3 | Example 4 |
|---|---|---|---|---|---|
| | pentachlorothiophenol | | | | |
| | Zinc stearate | 5 | 5 | 5 | 5 |
| Flight | W#1 Carry (m) | 217.7 | 216.8 | 215.6 | 216.5 |
| | HS45 Total Distance (m) | 228.6 | 228.7 | 229.3 | 227.5 |
| | Spin (rpm) | 2829 | 2795 | 2652 | 2829 |
| | Evaluation of travel distance | ○ | ○ | ○ | ○ |
| Durability against cracking | | ○ | ○ | ○ | ○ |
| Feeling | | | | | |
| W#1 | | ○ | ○ | ○ | ○ |
| I#9 | | ○ | ○ | ○ | ○ |

•Peroxide (1): Dicumyl peroxide - Percumyl D (NOF Corp.)
•Peroxide (2): 1,1-bis(t-butyl peroxide)3,3,5-trimethylcyclohexane - Perhexa 3M-40 (NOF Corp.)
•Antioxidant: Nocrac NS-6 (Ouchi Shinko Chemical Industry Co., Ltd.)
•Zinc salt of pentachlorothiophenol: Renacit IV (Bayer Corp.)
•$\mu$ Hardness: Deflection (deformation) amount (mm) when load was increased from initial load of 98 N (10 kgf) to 1275 N (130 kgf)

TABLE 2

| | | Comparative Example 1 | Comparative Example 2 | Comparative Example 3 | Comparative Example 4 | Comparative Example 5 |
|---|---|---|---|---|---|---|
| Ball | Diameter (mm) | 42.7 | 42.7 | 42.7 | 42.7 | 42.7 |
| | Weight (g) | 45.3 | 45.3 | 45.3 | 45.3 | 45.3 |
| | $\mu$ Hardness (mm) | 2.8 | 3.4 | 3.0 | 2.9 | 2.7 |
| Core | Diameter (mm) | 36.7 | 36.7 | 36.7 | 37.9 | 36.6 |
| | $\mu$ Hardness (mm) | 4.0 | 4.3 | 3.5 | 4.3 | 3.5 |
| | Surface JIS-C hardness: X | 75 | 74 | 81 | 75 | 73 |
| | Center JIS-C hardness: Y | 61 | 60 | 64 | 60 | 69 |
| | Hardness difference: X-Y | 14 | 14 | 17 | 15 | 4 |
| Cover | Cover material | c | d | e | b | a |
| | Thickness (mm) | 3.0 | 3.0 | 3.0 | 2.4 | 3.0 |
| | Shore D Hardness | 63 | 58 | 55 | 60 | 59 |
| Composition of core | Polybutadiene | 100 | 100 | 100 | 100 | 100 |
| | Zinc acrylate | 23.6 | 25.3 | 29.6 | 25.3 | 27.9 |
| | Peroxide (1) | 0.6 | 0.6 | 0.6 | 0.6 | 0.6 |
| | Peroxide (2) | 0.6 | 0.6 | 0.6 | 0.6 | 0.6 |
| | Antioxidant | — | — | — | — | 0.2 |
| | Barium sulfate | 23.7 | — | — | — | 21.8 |
| | Zinc oxide | 5.0 | 27.1 | 25.4 | 23.0 | 5.0 |
| | Zinc salt of pentachlorothiophenol | 0.2 | 1 | 1 | 1 | 0.4 |
| | Zinc stearate | — | 5 | 5 | 5 | — |
| Flight | W#1 Carry (m) | 217.0 | 212.1 | 214.1 | 216.2 | 217.0 |
| | HS45 Total Distance (m) | 230.7 | 225.8 | 225.9 | 229.2 | 225.2 |
| | Spin (rpm) | 2696 | 2692 | 2929 | 2693 | 2690 |
| | Evaluation of travel distance | ○ | x | x | ○ | x |
| Durability against cracking | | x | x | ○ | x | ○ |
| Feeling | | | | | | |
| W#1 | | ○ | ○ | ○ | ○ | ○ |
| I#9 | | x | ○ | ○ | ○ | ○ |

•Peroxide (1): Dicumyl peroxide - Percumyl D (NOF Corp.)

TABLE 2-continued

| | Comparative Example 1 | Comparative Example 2 | Comparative Example 3 | Comparative Example 4 | Comparative Example 5 |
|---|---|---|---|---|---|

•Peroxide (2): 1,1-bis(t-butyl peroxide)3,3,5-trimethylcyclohexane - Perhexa 3M-40 (NOF Corp.)
•Antioxidant: Nocrac NS-6 (Ouchi Shinko Chemical Industry Co., Ltd.)
•Zinc salt of pentachlorothiophenol: Renacit IV (Bayer Corp.)
•$\mu$ Hardness: Deflection (deformation) amount (mm) when load was increased from initial load of 98 N (10 kgf) to 1275 N (130 kgf)

TABLE 3

Cover Material (Unit: Parts by Weight)

| | a | b | c | d | e |
|---|---|---|---|---|---|
| Himilan 1706 (Zn) | — | — | 50 | 60 | — |
| Himilan 1650 (Zn) | — | — | — | — | 50 |
| Himilan 1557 (Zn) | 35 | 50 | — | — | — |
| Himilan 1705 (Zn) | — | — | — | 20 | — |
| Himilan 1855 (Zn) | 15 | — | — | 20 | — |
| Himilan 1605 (Na) | 30 | — | 50 | — | — |
| Himilan 1601 (Na) | — | 50 | — | — | — |
| Surlyn 8120 (Na) | 20 | — | — | — | 50 |
| Titanium Oxid | 5 | 5 | 5 | 5 | 5 |
| Shore D Hardness | 59 | 60 | 63 | 58 | 55 |

Himilan: Trade name of an ionomer resin from Du Pont Mitsui Polychemicals Co., Ltd.
Surlyn: Trade name of an ionomer resin from Du Pont, Ltd.
(Zn): ionomer resin neutralized by Zn ions
(Na) ionomer resin neutralized by Na ions As seen from Tables 1 and 2, the golf balls of the present invention have excellent flight performance and durability against cracking and provide excellent feeling on impact. By contrast, the golf balls of Comparative Examples involve the following drawbacks.

Comparative Example 1: Since the cover is excessively hard, durability against cracking is insufficient, and feeling upon hitting by an iron is bad.

Comparative Example 2: Since the cover is excessively soft and the cover is formed of only an ionomer resin neutralized by divalent metal ions ($Zn^{++}$), resilience is low, and travel distance is short. Further, durability against cracking is insufficient.

Comparative Example 3: Since the cover is excessively soft, spin is excessive, and resilience is low, with the result that travel distance is short.

Comparative Example 4: Since the cover is excessively thin, durability against cracking is insufficient.

Comparative Example 5: Since the difference in hardness between the surface and center of the core is excessively small, spin becomes excessive, with the result that travel distance is short.

What is claimed is:

1. A two-piece solid golf ball comprising a core and a cover, the golf ball satisfying the following conditions (1) to (5):

(1) the cover has a thickness of at least 2.5 mm;

(2) the cover has a Shore D hardness of 59 to 62;

(3) a value obtained through subtraction of JIS C hardness of a center portion of the core from JIS C hardness of a surface portion of the core is at least 8;

(4) the $\mu$-hardness of the core is 2.7 to 5.5 mm; and (5) the $\mu$-hardness of the entire ball is 2.3 mm to 3.5 mm, wherein the cover is formed of a material containing a dominant amount of a blend resin containing 10 to 90% by mass of an ionomer resin neutralized by divalent metal ions and 90 to 10% by mass of an ionomer resin neutralized by monovalent metal ions.

2. A two-piece solid golf ball according to claim 1, wherein the value obtained through subtraction of JIS C hardness of a center portion of the core from JIS C hardness of a surface portion of the core is 8 to 20.

3. A two-piece solid golf ball according to claim 2, wherein the core contains pentachlorothiophenol or a metallic salt of pentachlorothiophenol.

4. A two-piece solid golf ball according to claim 1, wherein the JIS C hardness of the core surface portion is typically 70 to 85.

5. A two-piece solid golf ball according to claim 1, wherein the JIS C hardness of the core center portion is 55 to 69.

6. A two-piece solid golf ball according to claim 1, wherein the core contains pentachlorothiophenol or a metallic salt of pentachlorothiophenol.

7. A two-piece solid golf ball according to claim 1, wherein the value obtained through subtraction of JIS C hardness of a center portion of the core from JIS C hardness of a surface portion of the core is 10 to 18.

* * * * *